United States Patent [19]

Sherby et al.

[11] Patent Number: 4,533,390

[45] Date of Patent: Aug. 6, 1985

[54] ULTRA HIGH CARBON STEEL ALLOY AND PROCESSING THEREOF

[75] Inventors: Oleg D. Sherby, Palo Alto; Toshimasa Oyama, Stanford, both of Calif.

[73] Assignee: Board of Trustees of the Leland Stanford Junior University, Stanford, Calif.

[21] Appl. No.: 537,793

[22] Filed: Sep. 30, 1983

[51] Int. Cl.[3] ..... C21D 7/14

[52] U.S. Cl. ..... 75/126 Q; 75/123 L; 148/36; 148/12 R; 148/12 C

[58] Field of Search ..... 75/126 Q, 126 D, 123 L, 75/128 C, 126 C, 123 J, 123 M; 148/36, 37, 12 R, 12 C, 31, 35

[56] References Cited

U.S. PATENT DOCUMENTS

| | | | |
|---|---|---|---|
| 3,762,964 | 10/1973 | Kranenberg | 148/12 R |
| 3,857,741 | 12/1931 | Hultgren et al. . | |
| 3,951,697 | 4/1976 | Sherby et al. | 148/36 |
| 4,043,843 | 8/1977 | Tanczyn | 75/126 Q |
| 4,448,613 | 5/1984 | Sherby et al. | 148/36 |

FOREIGN PATENT DOCUMENTS

| | | | |
|---|---|---|---|
| 0472171 | 9/1975 | U.S.S.R. | 75/123 L |

*Primary Examiner*—L. Dewayne Rutledge
*Assistant Examiner*—Debbie Yee
*Attorney, Agent, or Firm*—Fulwider Patton Rieber Lee & Utecht

[57] ABSTRACT

An ultra high carbon steel having a composition of carbon in an amount of from about 0.8 weight percent up to the maximum solubility limit of carbon in austenite; silicon in an amount of from about 3 to about 7 weight percent; an effective amount of a stabilizing element acting to stabilize iron carbide against graphitization in the presence of silicon; and the balance iron. Preferably, the silicon is present in an amount of about 3 weight percent, and the stabilizing element is chromium. The ultra high carbon steel may be processed to a form suitable for subsequent superplastic forming by any technique which reduces its grain size to about 10 microns or less, and preferably to about 0.4 to about 2 microns. The silicon and the stabilizing element act to produce a stable iron carbide particle array to retain the fine grain size during superplastic processing, and to increase the eutectoid temperature so that superplastic processing may proceed at high strain rates and low stress levels at elevated temperature.

19 Claims, 6 Drawing Figures

ULTRA HIGH CARBON STEEL ALLOY AND PROCESSING THEREOF

This invention was made with Government support under Contract Number DAAG-29-81-K-0080 awarded by the Army Research Office. The Government has certain rights in this invention.

BACKGROUND OF THE INVENTION

The present invention relates to metal alloys, and, more particularly, to an ultra high carbon steel suitable for superplastic processing.

Superplastic forming has emerged as an important manufacturing technique, because in many cases parts may be formed to essentially their final shape in a single step. Consequently, material costs and costs of secondary processing such as machining may be significantly reduced.

Superplastic behavior is ordinarily found in metals having fine grain sizes at elevated temperatures, and is marked by a high sensitivity of the stress to strain rate during deformation. This high sensitivity prevents the growth of mechanical instabilities during processing and results in the attainment of unusually high elongations before failure, sometimes exceeding 1000 percent. The high strain rate sensitivity and high elongations to failure in turn permit the use of specialized superplastic processing techniques.

To prepare an alloy for a superplastic forming operation, the alloy must first be processed to a fine grain structure. Although in some instances superplasticity is not related to grain size, in most instances a finer grain size results in increased superplastic strain rate for any selected stress level. Most alloys must therefore first be processed to a fine grain size which is stable when the alloy is reheated for superplastic forming. If the fine grain size is not sufficiently stabilized, the grains may coarsen so much during the superplastic forming operation that the superplastic property is lost before forming may be completed, and the forming operation fails. Thus, stabilization of fine grain structures is a key to improving superplastic formability.

Most of the commercial-scale applications of superplastic forming have utilized titanium, nickel, and aluminum alloys of interest in the aerospace industry. Iron-based superplastic alloys have also been developed, including, for example, the ultra high carbon steel disclosed in U.S. Pat. No. 3,951,697. This patent relates to a process for preparing a hypereutectoid steel having a fine grain size and an array of fine iron carbides to stabilize the fine grain size during subsequent superplastic processing. The superplastic forming is then accomplished just below the eutectoid (or $A_1$) temperature of about 725° C., since the steel does not exhibit the desirable superplastic property below about 600° C. or above about 750° C.

While the ultra high carbon superplastic steel represents a significant advance in the art, problems remain in its economic application on a widespread industrial scale. When the steel is heated to the range of superplasticity, the fine iron carbides tend to coarsen, with the result that the fine grains also grow to larger sizes. Since a fine grain size is required for superplasticity, the growth of the grains may result in the loss of the superplastic property, even though the steel is heated to the appropriate temperature range. The superplastic forming operation must be completed before the grain size grows too large. In some cases, the processing cannot be completed before the grains coarsen so much that the superplasticity is lost, thereby making the superplastic forming operation commercially impractical.

An important consequence of the increase in grain size during heating and superplastic processing is a reduction in the allowable superplastic forming strain rate. Studies and calculations have shown that an increase in grain size from about 0.4 microns to about 2 microns can be excpected to reduce the superplastic strain rate at constant stress by about a factor of 100. Since the strain rate is essentially the reciprocal of the forming time, it may be seen that grain size coarsening is expected to increase drastically the time required to form a part. And, during the lengthened forming time, even further coarsening occurs.

A further problem in the forming of iron-based superplastic alloys results from their inherently greater strength as compared with titanium-based or aluminum-based alloys. Because the iron-based alloys such as ultra high carbon steels are stronger, their superplastic forming requires larger, more powerful, and more costly forming equipment. It is conceivable that the iron-based alloys could be made inherently weak to allow their forming or smaller equipment, but this approach would also result in an undesirable reduction in the room-temperature strength of the furnished part.

Consequently, there has been a need for an improved iron-based alloy having a more stable microstructure to retain the as-processed fine grain size for longer times. Desirably, such an iron-based alloy would permit superplastic forming at high strain rates and low stresses, without sacrificing the room-temperature properties. The high strain rates and low stresses would allow the use of small equipment and increase production rates, thereby improving the economics of the superplastic forming operation. The present invention fulfills this need, and further provides related advantages.

SUMMARY OF THE INVENTION

The present invention relates to an improved ultra high carbon steel which may be processed to produce a fine grain size stabilized by an array of fine iron carbide particles that are stable at relatively higher temperatures and for longer times than previously known. The temperature range for superplastic forming is increased, so that the superplastic forming operation may be accomplished at a temperature where the strength of the steel is reduced without sacrificing its room-temperature properties.

An ultra high carbon steel in accordance with the invention may therefore be superplastically processed at higher strain rates and lower stresses than prior superplastic steels. The greater stability of the carbides leads to greater stability of the fine grain structure necessary for superplasticity, in turn increasing the superplastic strain rate and decreasing the total forming time. Consequently, the steel may be maintained at the superplastic forming temperature for longer times, so that more intricate parts may be formed if desired. Accordingly, the superplastic steel of the invention broadens the range of commercially feasible superplastic forming operations and articles that may be formed thereby.

In accordance with the invention, an iron-based alloy consists essentially of carbon in an amount of from about 0.8 weight percent up to the maximum solubility limit of carbon in austenite; silicon in an amount of from about 3 up to about 7 weight percent; an effective amount of a stabilizing element acting to stabilize iron carbides against graphitization in the presence of silicon; and the balance iron. Preferably, the stabilizing element is selected from a group consisting of chromium, molybdenum, tungsten, and titanium, and, most preferably, the stabilizing element is chromium in an amount of about 1.5 weight percent. Manganese may also be present, as in most steels, in an amount of about 0.5 weight percent. Also within the scope of the invention is a process for preparing a superplastically formable material having a grain size of less than about 10 microns, and preferably of about 0.4 to about 2 microns, and a process for superplastically forming such a material.

Preferably, the silicon is present in an amount of about 3 weight percent, and the stabilizing element is chromium, in an amount of about 1.5 weight percent. Further, it is desirable that the carbon content be maintained above about 1.0 weight percent to provide a suffcient volume fraction of iron carbide particles to stabilize the fine grain size.

The alloy of the present invention may be processed to a form suitable for further superplastic processing by any technique suitable for producing a stable grain structure having a grain size of less than about 10 microns, and preferably producing a grain size of about 0.4 to about 2 microns. Examples of such processing techniques include the processes disclosed in U.S. Pat. No. 3,951,697 and processes involving divorced eutectoid transformations with or without associated deformation.

The fine grain, stable material produced in accordance with the invention may be further superplastically processed by techniques known in the art. Because the steel of the invention may be superplastically processed at higher temperatures and lower stress levels than prior superplastically formable steels, techniques not previously feasible for forming superplatic steels may be used, such as the blow forming of sheet under an applied gas pressure.

It will be appreciated from the foregoing that the present invention represents a significant advance in the technology of iron-based alloys, and particularly in the technology of superplastically formable steels. With the alloy of the present invention, superplastic forming may be accomplished at lower stresses and higher strain rates than previously possible, thereby increasing the commercial applicability of superplastic forming of steels. Further, the fine grain structure of the steel is stable for longer times in the superplastic forming range. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

In accordance with the invention, an ultra high carbon steel consists essentially of carbon in an amount of from about 0.8 weight percent up to the maximum solubility limit of carbon in austenite; silicon in an amount of from about 3 to about 7 weight percent; an effective amount of a stabilizing element acting to stabilize iron carbides against graphitization in the presence of silicon; and the balance of the alloy iron totalling 100 percent. The alloy may also contain minor amounts of impurities customarily found in commercial steels, such as manganese, nickel, vanadium, and copper. The stabilizing element is selected from the group consisting of chromium, molybdenum, tungsten, and titanium. Most preferably, the stabilizing element is chromium, in an amount of about 1.5 weight percent, and the silicon is present in an amount of about 3 weight percent. The most preferred composition of the present invention is about 1.25 weight percent carbon, about 3 weight percent silicon, about 1.5 weight percent chromium, with the balance iron totalling 100 percent.

As used herein, a "steel" is an iron-based (also termed ferrous) alloy containing carbon and other alloying additions. Such a steel, besides containing alloying ingredients in accordance with the invention, may contain elements customarily found in commercial steels, such as manganese, in amounts not preventing attainment of the desirable properties afforded by the alloy of the present invention.

Figure 1:
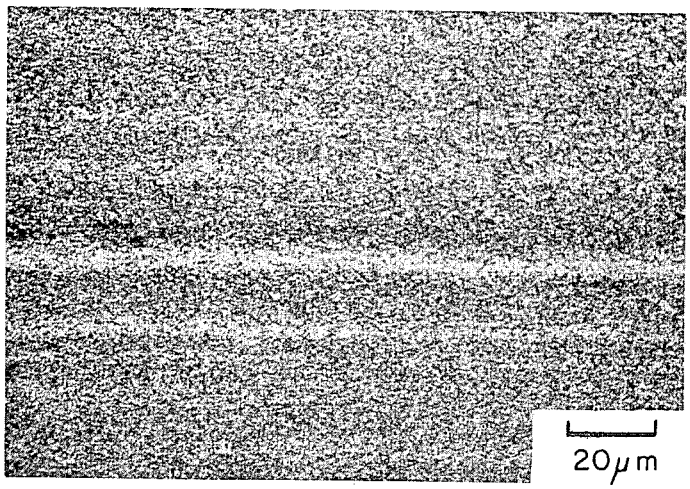
FIG. 1 is a photomicrograph illustrating an alloy prepared in accordance with the present invention, hving 1.25 weight percent carbon, 3 weight percent silicon, 1.5 weight percent chromium, 0.5 weight percent manganese, balance iron totalling 100 percent, and processed by a divorced eutectoid transformation with associated deformation procedure.

For use in superplastic processing operations, the steel of the present invention is first processed to a form having a distribution of fine grains with an array of carbide particles in the grain boundaries to inhibit growth of the grains, as illustrated in FIG. 1. The processing technique should produce a stable grain structure having an average grain size of less than about 10 microns, preferably from about 0.4 to about 2 microns, and most preferably 0.4 microns.

A number of processing techniques are known to produce a steel having such a fine grain structure and an array of carbide particles suitable for further superplastic processing, and the alloy of the present invention may be used in conjunction with any such processing technique. An example of a suitable processing technique is disclosed in U.S. Pat. No. 3,951,697, whose disclosure is herein incorporated by reference. As disclosed therein, one approach to preparing such a fine grain structure is by heating to a temperature of from about 500° C. to about 900° C., and then mechanically working the steel with sufficient deformation to refine the grain size and spheroidize the predominant portion of the iron carbide. Optionally, the process may also include homogenization and mechanical working of the steel at a temperature of from about 1100° to about 1150° C. prior to working in the range of from about 500° to about 900° C.

In another approach, a fine grain material may be produced by a process including a divorced eutectoid transformation or a divorced eutectoid transformation with associated deformation.

Briefly, a process for preparing a fine grain structure through divorced eutectoid transformation processing begins with heating the steel to a temperature in excess of the $A_{cm}$ transformation temperature, to form an austenite matrix in which substantially all of the carbon is dissolved. The steel is cooled to about the $A_1$ transformation temperature, while deforming the steel as by rolling during at least part of the cooling procedure, to refine the austenite grain size. The steel is further cooled to below the $A_1$ transformation temperature to transform the structure to a mixture of pearlite and proeutectoid carbides. The steel is reheated to a soaking temperature approximately 50° C. above the $A_1$ temperature, and held at that temperature for a time sufficient such that the carbides in pearlite are dissolved into the austenite in which the carbon is not uniformly distributed. The holding time depends upon the exact composition of the steel and the temperature chosen, but is typically in the range of a few minutes to one hour. Finally, the steel is cooled at a rate equivalent to air cooling to below the $A_1$ transformation temperature. Alternatively, the same processing procedure may be followed, but with mechanical working during the step wherein the dissolved carbon is not yet uniformly distributed in the austenite matrix, and possibly mechanically working as the steel is cooled below the $A_1$ temperature. This process variation is known as a divorced eutectoid transformation with associated deformation. Either approach results in a fine ferrite grain structure with an array of fine iron carbide particles in the grain boundaries serving to stabilize the grains against subsequent coarsening.

It is emphasized that the processing procedures described above for producing a fine grain ferrite structure having an array of iron carbide particles are intended to be exemplary. Other techniques for producing such structures are also suitable.

After the steel of the invention is processed to a fine grain size having an array of iron carbide particles serving to stabilize the fine grain size, the steel may be formed by any suitable superplastic deformation process. In such processes, the steel is heated in an appropriate apparatus to its superplastic temperature range at about the $A_1$ temperature. In the steel of the invention, the $A_1$ temperature is intentionally raised above the $A_1$ temperature for prior superplastic steels, and the superplastic processing is preferably accomplished at a temperature of from about 600° C. to about 900° C., and most preferably at a temperature of about 800° C.

The superplastic deformation may be accomplished with suitable tooling, such as press forming in open or closed dies. Additionally, as will be described more fully below, the increased $A_1$ temperature of the steel made in accordance with the invention reduces the stress required for superplastic deformation, so that superplastic forming techniques previously not suited for use with steel alloys may also be utilized. For example, in blow forming a sheet of superplastic material is forced into a female mold under an applied gas pressure. The applied gas pressure forces the sheet into the cavities of the mold without the need for complicated male tooling and with a pressure which is constantly and uniformly applied. Blow forming has been employed mainly for titanium and aluminum based superplastic alloys, but not widely for ferrous alloys because the greater strengths of the prior iron-based superplastic alloys require excessively high gas pressures.

Figure 3:
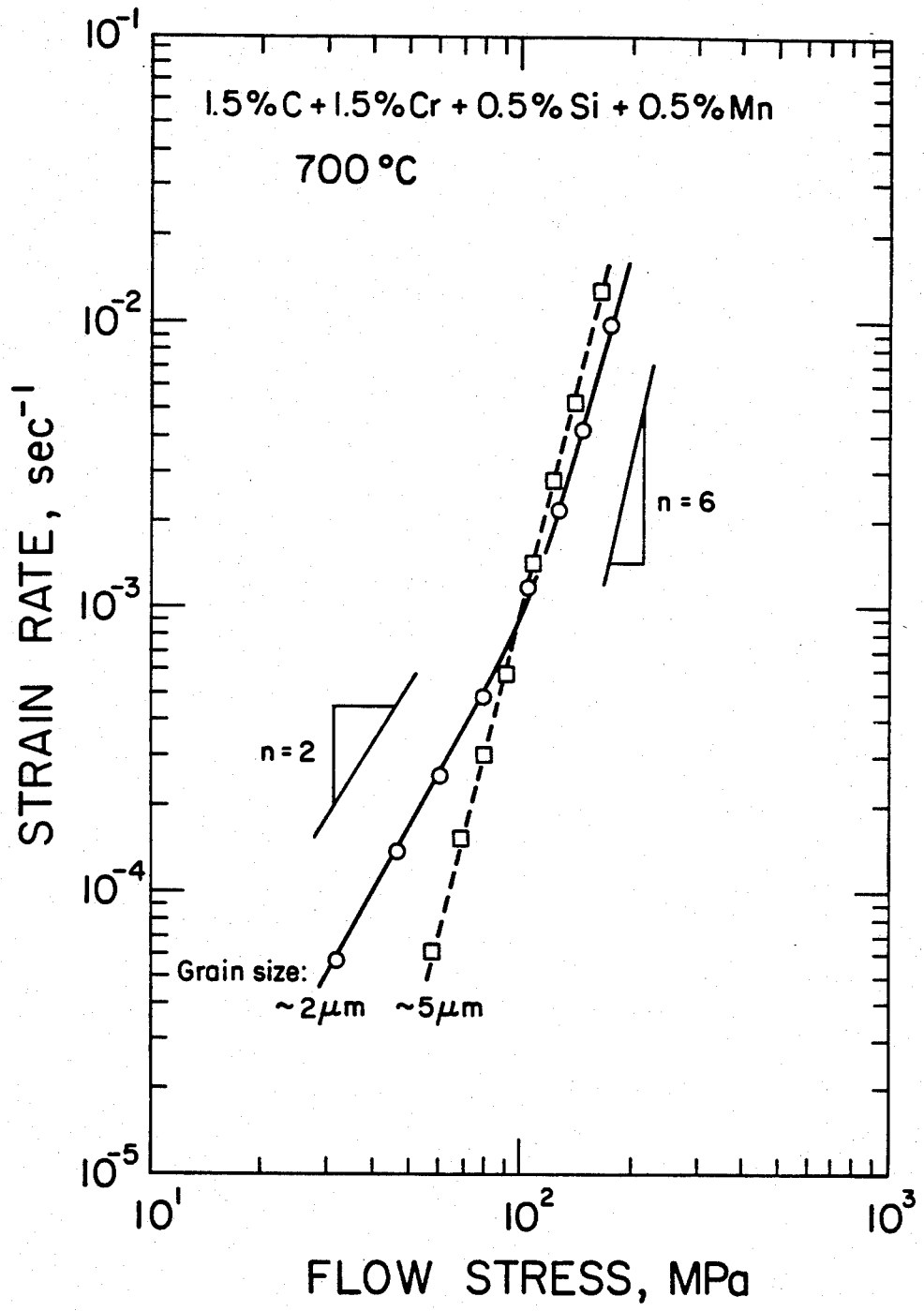
FIG. 3 is a graph of strain rate plotted against stress, illustrating the effect of refinements in the grain size for a prior steel having a composition of 1.5 weight percent carbon, 1.5 weight percent chromium, 0.5 weight percent silicon, 0.5 weight percent manganese, balance iron totalling 100 percent.

It has often been observed that metals having fine grain sizes exhibit superplastic properties. Most metals with very large grains do not exhibit superplasticity at any temperature, and superplasticity improves with decreasing grain size. Thus, for example, as shown in FIG. 3, a finer grain material usually exhibits better superplastic properties than coarse grain material. The strain rate sensitivity exponent m, the most commonly used measure of superplasticity, is the quantity relating flow stress $\sigma$ to strain rate $\dot{\epsilon}$ in the equation $\sigma = K\dot{\epsilon}^m$. A value of m of about 0.5 is typical for superplastic metallic alloys, with superplasticity also observed in alloys having m greater than about 0.5. In FIG. 3, a graph of log strain rate against log stress, the slopes of the lines yield the values of the stress exponent n, which is the reciprocal of m. Hence, values of n of about 2 or less indicate superplastic behavior.

It is therefore desirable and usually necessary that the fine grain structure be retained throughout the entire superplastic forming operation at elevated temperature. Although the values of grain size may vary somewhat in various circumstances, for ferrous alloys it is believed that little superplasticity is found, at conventionally slow strain rates, when the grain size is larger tha about 10 microns. Good superplasticity is observed at a grain size of about 2 microns, while a decrease of the grain size to about 0.4 microns results in an increased superplastic strain rate so as to make commercial forming operations economically feasible.

Because the superplastic forming operation occurs at elevated temperature, the grain tend to coarsen with increased temperature and exposure time at temperature, and this coarsening is accelerated by the simultaneous deformation. To stabilize the grains against grain growth at elevated temperature, a fine dispersion of iron carbide particles is provided by the initial working operation, forming an array of pinning sites in the grain boundaries.

At elevated temperatures these fine particles are themselves unstable and tend to coarsen, with the result that the grains also coarsen. It is believed that the silicon addition of the present invention retards the coarsening of the iron carbide particles by increasing the activity of carbon in ferrite. The rate of dissolution of the carbide particles is thereby reduced, so that the array of fine iron carbide particles does not coarsen as rapidly as would otherwise be expected. The silicon has the added benefit of raising the $A_1$ temperature, thereby raising the temperature range for superplastic processing.

The addition of a large amount of silicon by itself has undesirable side effects. The presence of silicon also accelerates the graphitization of the iron carbide. Iron carbide ($Fe_3C$) is not the lowest energy state of carbon and iron, so that over long periods of time the iron carbide tends to decompose to iron and graphite. In the absence of large amounts of silicon, this decomposition normally occurs over a period of many years, even at elevated temperatures. However, in the presence of silicon the graphitization is greatly accelerated and may occur in a period of minutes or hours at the superplastic forming temperature. The graphitization is undesirable in that the transformation is accompanied by a reduction in the volume fraction of second phase iron carbide particles, thereby reducing their effectiveness in stabilizing the fine grain size. The stabilizing effect of the particles of the fine grains is believed to decrease with decreasing volume fraction.

A stabilizing element is provided in the alloy of the present invention to stabilize the iron carbide against graphitization in the presence of silicon. Suitable stabilizing elements include, for example, chromium, molybdenum, tungsten, an titanium. Although the applicant does not wish to be bound by this possible explanation, in the case of the preferred chromium stabilizing element, it is believed that the chromium stabilizes the particle size by changing its composition from iron carbide ($Fe_3C$) to an iron-chromium carbide $(FeCr)_3C$. This iron-chromium carbide is more stable to graphitization at elevated temperatures than is the iron carbide, so that even in the presence of silicon the carbide phase is resistant to graphitization.

Figure 4:
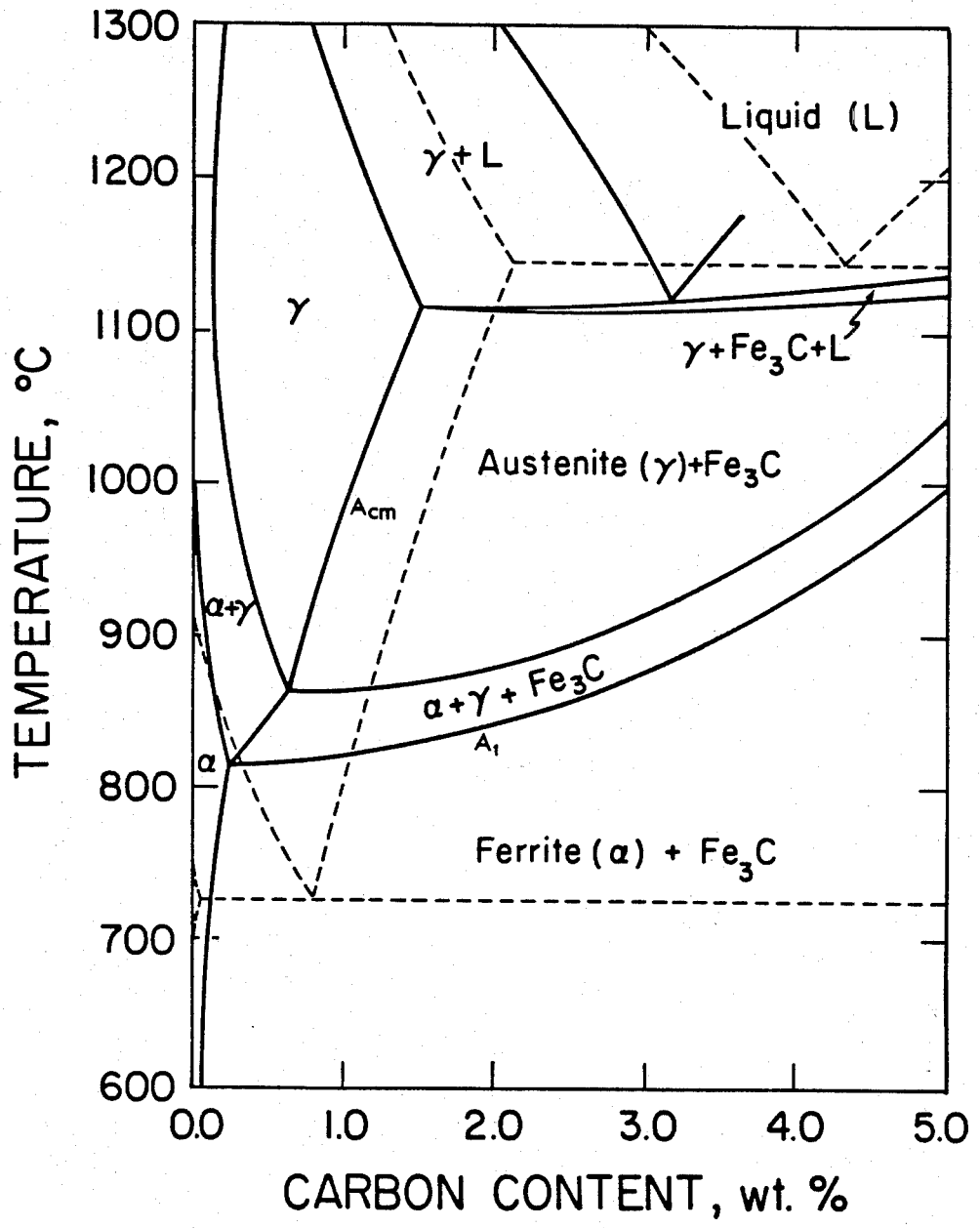
FIG. 4 is a proposed phase diagram illustrating the effect of alloying additions in accordance with the present invention in solid lines, and the iron-carbon phase diagram in dashed lines.

Additionally, it is known that the elements silicon, chromium, molybdenum, tungsten, and titanium each individually raise the $A_1$ temperature of iron-carbon alloys, and it is therefore believed that a combination of these alloying elements also increases the $A_1$ temperature. FIG. 4 illustrates a proposed form of a section of the iron-carbon-silicon phase diagram at 3 percent silicon. The temperature at which the ferrite begins to transform to the austenite phase upon heating, herein defined as the $A_1$ temperature, is raised from about 725° C. for the iron-carbon system to about 825° C. for the iron-carbon-silicon system, at a carbon content of about 1.25 weight percent and a silicon content of about 3 percent.

It is believed that the addition of certain other alloying elements would either further increase the $A_1$ temperature, or at least not significantly reduce the $A_1$ temperature, so that the selection of a stabilizing element is preferably made from this group. Presently known elements raising the $A_1$ temperature are chromium, molybdenum, tungsten, and titanium, and use of these elements, or combinations thereof, is preferred. Chromium and molybdenum are preferred to titanium and tungsten as stabilizing elements, as it is believed that titanium and tungsten form very hard carbides which are essentially undeformable and may lead to cracking at the particle-matrix interface. By contrast, chromium and molybdenum form carbides with iron and carbon which are more deformable. Chromium is preferred to molybdenum because chromium carbides are generally more deformable than molybdenum carbides and because of the presently lower price of chromium.

To achieve the benefits of the invention, the silicon content of the steel should be greater than about 3 weight percent, and less than about 7 weight percent, and most preferably about 3 weight percent. Although silicon in amounts less than 3 weight percent may have a beneficial effect on the retarding of coarsening of the iron carbide particles, the increase in the $A_1$ temperature becomes significant only at silicon levels of greater than about 3 weight percent. For example, the $A_1$ temperature without any silicon addition is about 725° C., the $A_1$ temperature for about 1.5 weight percent silicon is about 760° C., the $A_1$ temperature for about 3 weight percent silicon is about 820° C., and the $A_1$ temperature for about 6 weight percent silicon is about 930° C. At 1.5 percent silicon, for example, the small increase in the $A_1$ temperature is not sufficient to justify the cost of the silicon and stabilizer element additions.

If the carbon content is below about 0.8 weight percent, the volume fraction of iron carbides produced is insufficient to provide the desired stabilizing effect. Thus, the addition of silicon to an iron-carbon alloy reduces the maximum solubility of carbon in austenite. The upper limit of the silicon addition that will allow the maximum solubility of carbon to be maintained above 0.8 weight percent is about 7 weight percent silicon, and the maximum silicon addition is therefore limited to this level. Most preferably, the silicon content is maintained at the low end of the acceptable range of about 3 to about 7 weight percent, to achieve a desirable increase in the $A_1$ temperature while also allowing a high carbon content.

The stabilizing element is provided in an amount sufficient to stabilize the iron carbide against graphitization in the presence of silicon. In the most preferred embodiment wherein chromium is used, very slight but acceptable amounts of graphitization are observed after superplastically forming an alloy having 1.25 weight percent carbon, 3 weight percent silicon, 1.5 weight percent chromium, and 0.5 weight percent manganese, with the balance iron. It is therefore believed that a chromium content of substantially less the 1.5 weight percent is insufficient to provide the necessary stabilizing of the particles against graphitization. Additions of the stabilizing element substantially above the minimum required for stabilization are not expected to have significant beneficial effects, and may be detrimental in forming other phases in the steel. Chromium may not be added in an amount greater than about 13 weight percent, as a larger addition would reduce the maximum solubility limit of carbon in austenite below about 0.8 weight percent. For the same reason, molybdenum may not be added in an amount greater than about 3 weight percent.

The carbon content is chosen to lie between about 0.8 weight percent and the carbon content corresponding to the maximum solubility limit of carbon in austenite. At lower levels of carbon, an insufficient amount of iron carbide precipitate is formed, while at higher carbon contents, large, blocky, iron carbide particles are formed rather than an array of fine carbide particles. Preferably, the carbon content is as large as possible without exceeding this solubility limit to provide the highest volume fraction possible of the iron carbide precipitate. For the minimum silicon content of about 3 weight percent, the maximum carbon content possible is about 1.4 weight percent.

The following examples are intended to illustrate the application of the present invention to the preparation of steels, and are not intended to limit the scope of the invention.

EXAMPLE 1

A steel was prepared having a composition of 1.25 weight percent carbon, 3 weight percent silicon, 1.5 weight percent chromium, 0.5 weight percent manganese, balance iron, by air melting. After casting, the alloy was forged and then rolled commencing at a temperature of 1150° C. The temperature of the steel decreased during the rolling passes to about 700° C. No surface or edge cracks were observed in the rolled product. By contrast, an iron-3 weight percent silicon alloy cannot be processed without cracking under similar processing procedures.

EXAMPLE 2

A steel first prepared as described in Example 1 was reheated to 850° C. for 60 minutes and then rolled to a strain of −1.24 as it was cooled to about 650° C., to accomplish a divorced eutectoid transformation with associated deformation. The microstructure of this steel is illustrated in FIG. 1.

EXAMPLE 3

Figure 2:
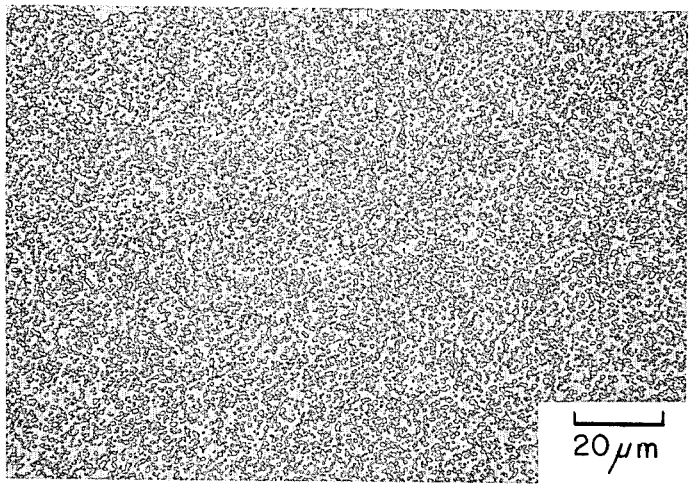
FIG. 2 is a photomicrograph further illustrating the alloy of FIG. 1, after heating the alloy to 800° C. for 3 hours.

A steel prepared by the process of Example 2 was heated to 800° C. and held at this temperature for 3 hours. The microstructure of this steel is illustrated in FIG. 2.

EXAMPLE 4

Figure 5:
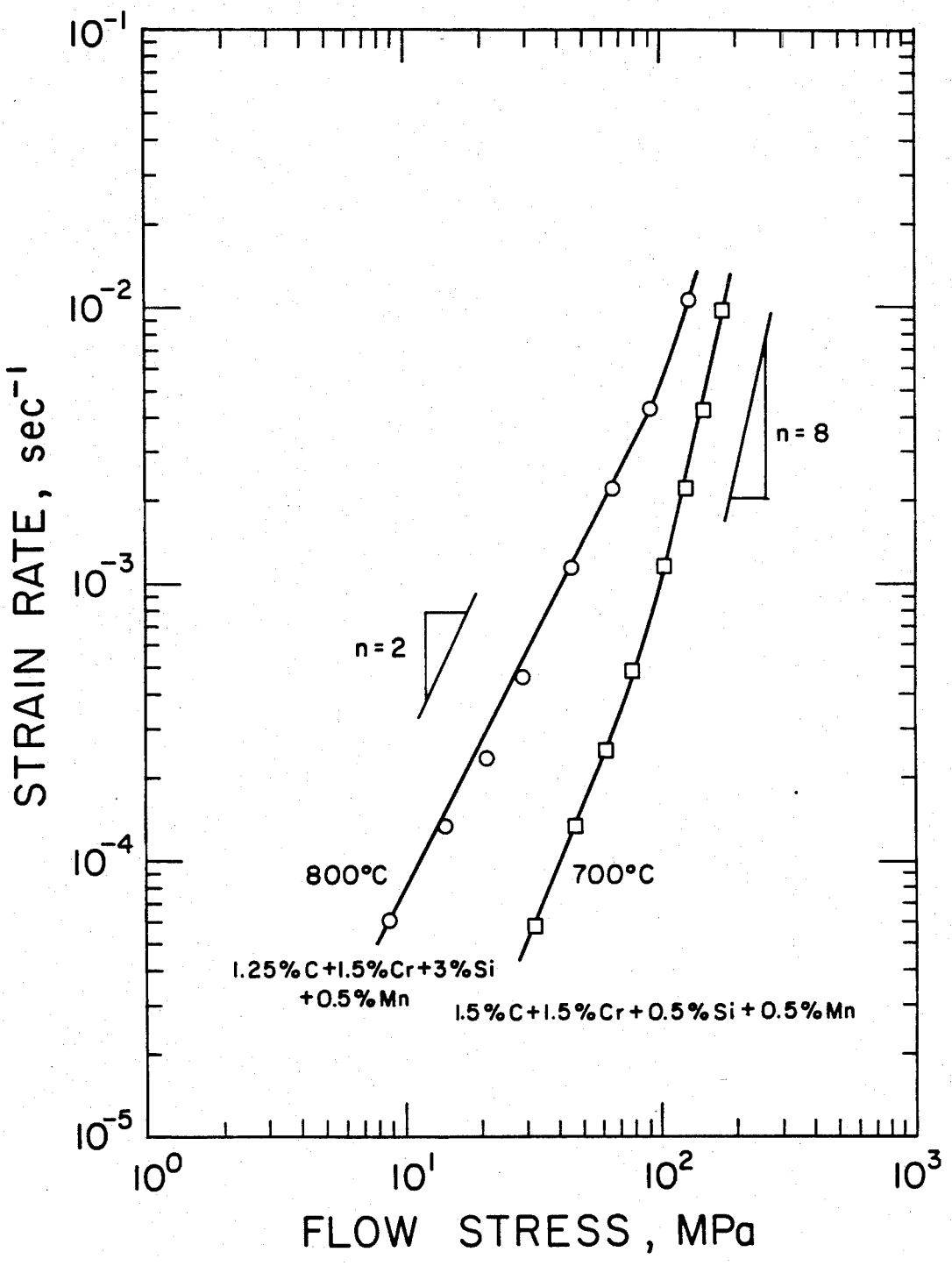
FIG. 5 is a graph of strain rate plotted against stress for the alloy of the present invention as compared with a prior steel, at temperatures within their respective superplastic forming temperature ranges.
Figure 6:
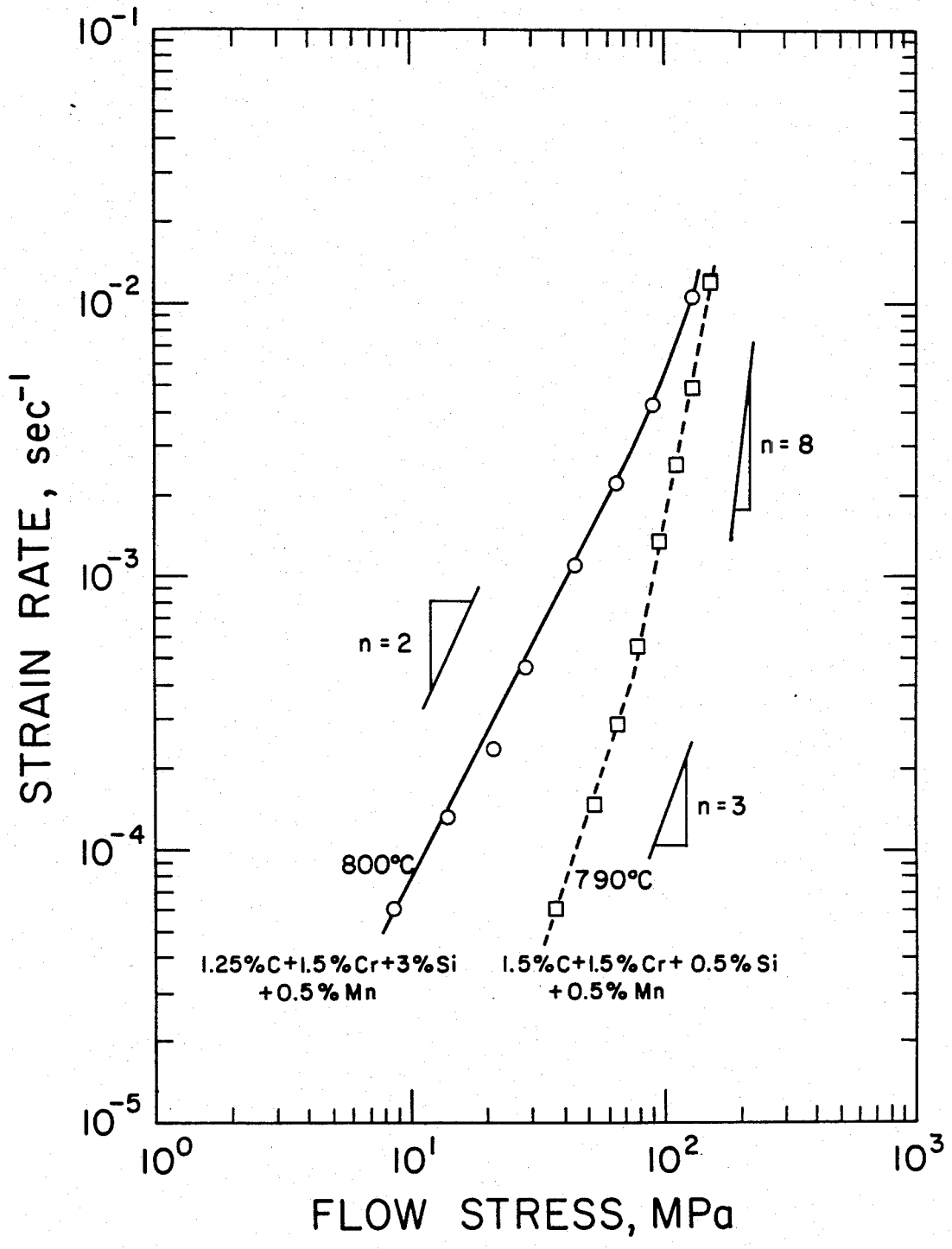
FIG. 6 is a graph of strain rate plotted against stress at about 800° C. for an alloy in accordance with the present invention and for a prior steel.

A sample of steel prepared by the process of Example 2 was tensile tested at 800° C. by the incremental strain rate method to determine its strain rate sensitivity, with the results shown in FIG. 5. The steel was superplastic, having a strain rate sensitivity exponent m of about 0.5. By contrast, a standard ultra high carbon steel having 1.25 weight percent carbon, 1.5 weight percent chromium, 0.5 weight percent manganese, 0.5 weight percent silicon, balance iron, exhibits a strain rate sensitivity exponent m of about 0.30 at 790° C., and is therefore not superplastic at this temperature in part because of excessive grain growth, FIG. 6. Further, it is observed from FIGS. 5 and 6 that the steel prepared in accordance with the present invention exhibits a low resistance to plastic flow in the superplastic range at low strain rates; for example, a flow stress of about 14 MPa at a strain rate of $10^{-4}$ per second at 800° C. At this stress level, commercial superplastic blow forming with existing equipment is feasible. By contrast, as illustrated in FIG. 5, superplastic ultra high carbon steels made previously were three times stronger than the alloy made in accordance with the present invention, in their superplastic range; for example, a flow resistance of 40 MPa at a strain rate of $10^{-4}$ per second at 700° C.

EXAMPLE 5

A steel prepared by the process of Example 2 was tensile tested at 800° C. The elongation of this material was about 500 percent at a strain rate of 100 percent per minute, indicating superplastic behavior at this temperature.

EXAMPLE 6

A steel prepared by the process of Example 2 was tensile tested at room temperature. The tensile strength of this fully annealed steel was about 1400 MPa with a total elongation of about 12 percent. By contrast, a prior steel having a composition of 1.5 weight percent carbon, 1.5 weight percent chromium, 0.5 weight percent manganese, 0.5 weight percent silicon, balance iron, and processed by the same procedure, had a tensile strength of about 1100 MPa and a total elongation of about 20 percent.

It will now be appreciated that, through the use of this invention, a steel having improved superplastic forming properties may be prepared. The steel may be superplastically formed at a higher temperature than prior steels, and at lower stresses and higher strain rates. Additionally, the fine grain size of the steel necessary for superplasticity is stabilized through the stabilization of the iron carbide particles, so that the steel may be exposed to the superplastic forming temperature for long periods of time. The steel of the invention, as-superplastically processed, has better room temperature strength than prior superplastically processed steels.

Although a particular embodiment of the invention has been described in detail for purposes of illustration, various modifications may be made without departing from the spirit and scope of the invention. Accordingly, the invention is not to be limited except as by the appended claims.

What is claimed is:

1. An ultra high carbon steel, consisting essentially of carbon in an amount of from about 0.8 weight percent up to the maximum solubility limit of carbon in austenite, silicon in an amount of from about 3 up to about 7 weight percent, an effective amount of a stabilizing element acting to stabilize iron carbides against graphitization in the presence of silicon, balance iron totalling 100 weight percent.

2. The steeel of claim 1, wherein the stabilizing element is selected from the group consisting of chromium, molybdenum, tungsten, titanium, and combinations thereof.

3. The steel of claim 1, wherein the stabilizing element is chromium.

4. The steel of claim 1, wherein the composition is about 1.25 weight percent carbon, about 3 weight percent silicon, about 1.5 weight percent chromium, balance iron.

5. The steel of claim 1, additionally containing about 0.5 weight percent manganese.

6. The steel of claim 1, additionally containing minor amounts of elements conventionally found in steel.

7. An article made by superplastically forming an ultra high carbon steel having a composition as set forth in claim 1.

8. An ultra high carbon steel consisting essentially of carbon in an amount of from about 0.8 weight percent up to the maximum solubility limit of carbon in austenite, from about 3 to about 7 weight percent silicon, from about 1.5 to about 13 weight percent chromium, balance iron totalling 100 weight percent.

9. A process for producing an ultra high carbon steel, comprising the steps of:

preparing an alloy consisting essentially of carbon in an amount of from about 0.8 weight percent up to the maximum solubility limit of carbon in austenite, silicon in an amount of from about 3 up to about 7 weight percent, an effective amount of a stabilizing element acting to stabilize iron carbide against graphitization in the presence of silicon, minor amounts of impurity elements conventionally found in steels, balance iron totalling 100 weight percent; and processing the alloy to have an average grain size of less than about 10 microns.

10. The process of claim 9, wherein the composition of the alloy includes from about 0.8 to about 1.4 weight percent carbon, from about 3 to about 7 weight percent silicon, a stabilizing element selected from the group consisting of chromium, molybdenum, tungsten, and titanium, minor amounts of impurity elements conventionally found in steels, and the balance iron.

11. The process of claim 9, wherein the stabilizing element is chromium.

12. The process of claim 9, wherein the composition of the ultra high carbon steel is about 1.25 weight percent carbon, about 3 weight percent silicon, about 1.5 weight percent chromium, minor amounts of impurity elements conventionally found in steels, balance iron.

13. The process of claim 9, wherein said step of processing is accomplished by a divorced eutectoid transformation.

14. The process of claim 9, wherein said step of processing is accomplished by a divorced eutectoid transformation with associated deformation.

15. The process of claim 9, wherein said step of processing includes a step of mechanically working the alloy to refine the iron grain size and spheroidize iron carbides present.

16. The process of claim 9, including the further step of:

superplastically forming the processed alloy, performed after said step of processing.

17. An article made by the process of claim 9.

18. An article made by the process of claim 16.

19. The process of claim 11, wherein the chromium is present in an amount of from about 1.5 to about 13 weight percent.

* * * * *